US012369769B2

(12) United States Patent
Schlögl et al.

(10) Patent No.: US 12,369,769 B2
(45) Date of Patent: Jul. 29, 2025

(54) DOMESTIC DISHWASHER

(71) Applicant: BSH Hausgeräte GmbH, Munich (DE)

(72) Inventors: Peter Schlögl, Dillingen (DE); Daniel Miller, Finningen (DE)

(73) Assignee: BSH Hausgeräte GmbH, Munich (DE)

( * ) Notice: Subject to any disclaimer, the term of this patent is extended or adjusted under 35 U.S.C. 154(b) by 50 days.

(21) Appl. No.: 18/019,495

(22) PCT Filed: Sep. 9, 2021

(86) PCT No.: PCT/EP2021/074803
§ 371 (c)(1),
(2) Date: Feb. 3, 2023

(87) PCT Pub. No.: WO2022/063592
PCT Pub. Date: Mar. 31, 2022

(65) Prior Publication Data

US 2024/0252016 A1 Aug. 1, 2024

(30) Foreign Application Priority Data

Sep. 24, 2020 (DE) ..... 102020212055.2

(51) Int. Cl.

| | |
|---|---|
| ***A47L 15/22*** | (2006.01) |
| ***A47L 15/23*** | (2006.01) |
| ***A47L 15/42*** | (2006.01) |
| ***A47L 15/44*** | (2006.01) |

(52) U.S. Cl.
CPC ..... *A47L 15/4282* (2013.01); *A47L 15/22* (2013.01); *A47L 15/23* (2013.01); *A47L 15/4409* (2013.01); *A47L 15/4436* (2013.01)

(58) Field of Classification Search
None
See application file for complete search history.

(56) References Cited

U.S. PATENT DOCUMENTS

| | | | | |
|---|---|---|---|---|
| 9,220,393 | B2 | 12/2015 | Becker | |
| 2011/0203623 | A1 | 8/2011 | Delgado | |
| 2013/0087173 | A1* | 4/2013 | Welch | A47L 15/4445 222/173 |
| 2016/0296097 | A1 | 10/2016 | Dreossi | |
| 2020/0397213 | A1 | 12/2020 | Kwon | |

FOREIGN PATENT DOCUMENTS

| | | | |
|---|---|---|---|
| DE | 102010042579 | A1 | 4/2012 |
| EP | 2441368 | A2 | 4/2012 |

OTHER PUBLICATIONS

National Search Report DE 10 2020 212 055.2 dated Jun. 7, 2021.
International Search Report PCT/EP2021/074803 dated Nov. 26, 2021.

* cited by examiner

*Primary Examiner* — Levon J Shahinian
(74) *Attorney, Agent, or Firm* — Michael E. Tschupp; Andre Pallapies; Brandon G. Braun

(57) ABSTRACT

A household dishwasher includes a dishwasher interior, a spraying facility rotatably mounted in the dishwasher interior for spraying wash liquor and/or fresh water upon an item to be washed received in the dishwasher interior, a placement region for placement of a cleaning agent, and a blocking facility configured to block a rotational movement of the spraying facility in such a manner that the spraying facility during blocking of the spraying facility selectively sprays the placement region with wash liquor and/or fresh water in order to dissolve the cleaning agent.

20 Claims, 7 Drawing Sheets

DOMESTIC DISHWASHER

CROSS-REFERENCES TO RELATED APPLICATIONS

This application is the U.S. National Stage of International Application No. PCT/EP2021/074803, filed Sep. 9, 2021, which designated the United States and has been published as International Publication No. WO 2022/063592 A1 and which claims the priority of German Patent Application, Serial No. 10 2020 212 055.2, filed Sep. 24, 2020, pursuant to 35 U.S.C. 119 (a)-(d).

The contents of International Application No. PCT/EP2021/074803 and German Patent Application, Serial No. 10 2020 212 055.2 are incorporated herein by reference in their entireties as if fully set forth herein.

BACKGROUND OF THE INVENTION

The present invention relates to a household dishwasher.

A dishwasher has a dishwasher interior for receiving items to be washed. For this purpose, the dishwasher interior accommodates receptacles for items to be washed, such as, for example, an upper basket or a lower basket. Rotatable spray arms can be provided above and/or below the receptacles for items to be washed. In particular, a lower spray arm and an upper spray arm can be provided. As a wash program is started, after a metering facility that is provided on a door of the dishwasher has been opened a cleaning agent drops into a so-called tab tray that can be provided on the upper basket, for example. This tab tray is provided with a downwards water-permeable geometry. This geometry is designed in such a manner that a spray nozzle of the spray arm dissolves the cleaning agent. However, the cleaning agent is only flushed out during the passage of the spray arm below the tab tray. However, the passage covers a maximum angle of 35° of the spray arm rotation. As a result, complete dissolution of the cleaning agent takes a comparatively long time. This needs to be improved.

BRIEF SUMMARY OF THE INVENTION

Against this background, an object of the present invention is to provide an improved household dishwasher.

Accordingly, a household dishwasher having a dishwasher interior, a spraying facility that is rotatably mounted in the dishwasher interior so as to spray items to be washed, which are received in the dishwasher interior, with wash liquor and/or fresh water, said household dishwasher having a placement region on or in which a cleaning agent can be placed and a blocking facility which is configured so as to block a rotational movement of the spraying facility in such a manner that the spraying facility during the blocking of the spraying facility selectively sprays the placement region with wash liquor and/or fresh water in order to dissolve the cleaning agent.

As a result of the spray arm being stopped and the placement region only being selectively sprayed with wash liquor and/or fresh water, it is possible to dissolve the cleaning agent more quickly in comparison to a household dishwasher without such a blocking facility. This results in the cleaning effect of the cleaning agent developing more quickly. This, in turn, allows the wash program to be shortened. This leads to an increase in convenience and to energy savings.

The dishwasher interior is in particular cube-shaped or cuboid-shaped. The dishwasher interior comprises a floor, on which a pump pot can be provided, a ceiling that is arranged opposite the floor, a rear wall and two side walls that are arranged opposite one another. The dishwasher interior can be closed by means of a door that is pivotally mounted on the dishwasher interior. The door is arranged opposite the rear wall in a closed state. A metering facility which can receive the cleaning agent can be provided on the door. At the commencement of a wash program, the metering facility opens and the cleaning agent drops out.

The household dishwasher preferably comprises a plurality of receptacles for items to be washed, for example a lower basket, an upper basket and a cutlery drawer. The receptacles for items to be washed are arranged one above the other in the dishwasher interior and can be moved out of and into the dishwasher interior. The receptacles for items to be washed can be loaded with items to be washed, which can be sprayed with wash liquor and/or fresh water by means of the spraying facility. The placement region can be arranged at one of the receptacles for items to be washed.

In particular, a coordinate system having an x-direction or width direction, a y-direction or height direction, and a z-direction or depth direction is assigned to the dishwasher interior or the household dishwasher. The directions are oriented perpendicular with respect to one another. The height direction is oriented from the floor in the direction of the ceiling of the dishwasher interior. The width direction is oriented from a first side wall in the direction of a second side wall. The depth direction is oriented from the rear wall in the direction of the closed door.

The placement region can be box-shaped or trough-shaped. For example, the placement region can be attached to one of the receptacles for items to be washed. The placement region is or can be designated as a tab tray. For example, the cleaning agent can be in powder form, liquid form, or tablet form. It is preferred that the cleaning agent is in tablet form. The blocking facility is suitable for blocking the spraying facility mechanically, electronically or in any other desired manner.

According to one embodiment, the placement region is provided on a receptacle for items to be washed that is accommodated in the dishwasher interior.

It is preferred that the placement region is provided on an upper basket. The placement region can be cup-shaped or box-shaped, as previously mentioned. It is preferred that the placement region is provided on a front side of the respective receptacle for items to be washed. However, the placement region can be provided at any location within the dishwasher interior.

According to a further embodiment, the spraying facility is rotatably mounted on the receptacle for items to be washed.

It is preferred that a duct is provided on the receptacle for items to be washed, via which wash liquor and/or fresh water can be supplied to the spraying facility. The duct can be coupled to a hydraulic system or water-filling system of the household dishwasher. It is preferred that the spraying facility is rotatably mounted on the duct, wherein the duct can in turn be fixedly connected to the receptacle of items to be washed.

According to a further embodiment, the spraying facility is arranged below the placement region when viewed along a direction of gravity.

In other words, the spraying facility sprays the placement region with the wash liquor and/or the fresh water against the direction of gravity. In other words, the cleaning agent is sprayed from below.

According to a further embodiment, the blocking facility unblocks the spraying facility as soon as a residual weight of the cleaning agent falls below a predetermined limit value.

For example, the blocking facility does not unblock the spraying facility until the cleaning agent is completely or at least approximately dissolved. However, the blocking facility can already unblock the spraying facility when the cleaning agent is, for example, 80% dissolved, in particular 90% dissolved, preferably 95% dissolved, further preferably 99% dissolved. The unblocking can be done mechanically or electronically, for example. For example, a weight detection facility is provided for detecting the residual weight of the cleaning agent. However, the blocking can also be removed after a predetermined period of time has elapsed. For example, it can be assumed that the cleaning agent is nearly dissolved after being sprayed with wash liquor and/or fresh water for five minutes.

According to a further embodiment, the placement region comprises a geometry that is configured so as to fan out a spray jet of the spraying facility.

For example, the geometry is wedge-shaped or frusto-conical. By fanning out the spray jet, better wetting of the cleaning agent is achieved. As a result, the cleaning agent dissolves more quickly.

According to a further embodiment, the spraying facility is actively driven by means of a drive element, wherein so as to block the rotational movement of the spraying facility the blocking facility activates the drive element in such a manner that the spraying facility is blocked.

In this case, the blocking facility operates electrically or electronically. For example, when at least one spray nozzle of the spraying facility is below the placement region, the drive element is no longer energized, so that the rotational movement of the spraying facility is blocked. In this case, the blocking facility can, for example, be part of a control unit of the household dishwasher. In particular, the blocking facility can also be part of a wash program that is stored in the control unit.

According to a further embodiment, the spraying facility is driven by means of wash liquor and/or fresh water emerging from the spraying facility, wherein so as to block the rotational movement of the spraying facility the blocking facility mechanically blocks the spraying facility.

For this purpose, the spraying facility can have drive nozzles from which the wash liquor and/or fresh water emerges in order to set the spraying facility in rotation. In the present context, a "mechanical" blocking is to be understood to mean that the spraying facility is directly prevented from rotating by a component, for example by the placement region, regardless of whether or not wash liquor and/or fresh water emerge from the drive nozzles of the spraying facility.

According to a further embodiment, the blocking facility comprises a rotatably mounted rocker which has the placement region at a first end portion and a counterweight to the cleaning agent at a second end portion that is remote from the first end portion, wherein so as to block the rotational movement of the spraying facility the placement region is in contact with the spraying facility.

For example, the rocker is rotatably mounted on a receptacle for items to be washed. In particular, the rocker can be provided on the underside of the receptacle for items to be washed. As soon as the cleaning agent is placed on or in the placement region, the rocker tilts about a bearing location in such a manner that the placement region blocks the spray arm so that said spray arm cannot rotate. When the cleaning agent is dissolved, the counterweight moves the placement region back out of a rotation region of the spraying facility so that the rotational movement of the spraying facility is no longer blocked.

According to a further embodiment, the placement region comprises a stop which is in contact with a corresponding counter stop of the spraying facility so as to block the rotational movement of the spraying facility.

For example, the stop is a pin or the like that extends out of the underside of the placement region. The counter stop can be a pin which corresponds thereto and which extends out of the upper side of the spraying facility.

According to a further embodiment, the rocker is mounted off-center.

"Off-center" in the present case means in particular that the bearing location of the rocker is provided, for example, closer to the counterweight than to the placement region with the cleaning agent.

According to a further embodiment, a first lever arm of the cleaning agent is larger than a second lever arm of the counterweight.

In other words, the cleaning agent is further from the bearing location than the counterweight.

According to a further embodiment, the counterweight is modifiable and/or a bearing location of the rocker is displaceable in order to adapt the blocking facility to different types of cleaning agent.

For example, the counterweight can be made of metal, concrete or plastic. The counterweight can also be formed by a certain amount of wash liquor and/or fresh water. In the present context, different "types" of cleaning agent means that, for example, different cleaning agent tablets with different weights can be used. Depending on the weight of the respective cleaning agent, either the counterweight is changed or the bearing location is displaced.

According to a further embodiment, the placement region is mounted in the dishwasher interior in such a manner as to be able to rotate about an axis of rotation, wherein the cleaning agent displaces the placement region against a spring force of a spring element in such a manner that the placement region mechanically blocks the spraying facility so as to block the rotational movement of the spraying facility.

In this case, the placement region is in particular trough-shaped or box-shaped. The placement region is mounted, for example, on one of the receptacles for items to be washed in such a manner as to be able to rotate about the axis of rotation. The spring element is provided on the underside of the placement region. The spring element can also be provided on the receptacle for items to be washed. In the event that the placement region is empty, the spring element moves the placement region in such a manner that it does not collide with the spraying facility and thus also does not block the rotational movement of the spraying facility. As soon as the cleaning agent is deposited in the placement region, a weight force of the cleaning agent compresses the spring element so that the placement region moves into the rotation region of the spraying facility and thus blocks it. Multiple spring elements can be provided.

According to a further embodiment, the placement region releases the spraying facility as soon as a weight force of the cleaning agent is smaller than the spring force.

In other words, as soon as the cleaning agent has dissolved, the spring element pushes the placement region out of the rotation range of the spraying facility so that it is no longer blocked.

Further possible implementations of the household dishwasher also comprise, not explicitly mentioned, combinations of features or embodiments that are described previously or below with respect to the exemplary embodiments. In this regard, the skilled person will also add individual aspects as improvements or additions to the respective basic form of the household dishwasher.

BRIEF DESCRIPTION OF THE DRAWINGS

Further advantageous embodiments and aspects of the household dishwasher are the subject matter of the subordinate claims and the exemplary embodiments of the household dishwasher described below. In the following, the household dishwasher will be explained in more detail on the basis of preferred embodiments with reference to the accompanying figures.

DETAILED DESCRIPTION OF EXEMPLARY EMBODIMENTS OF THE PRESENT INVENTION

Figure 1:
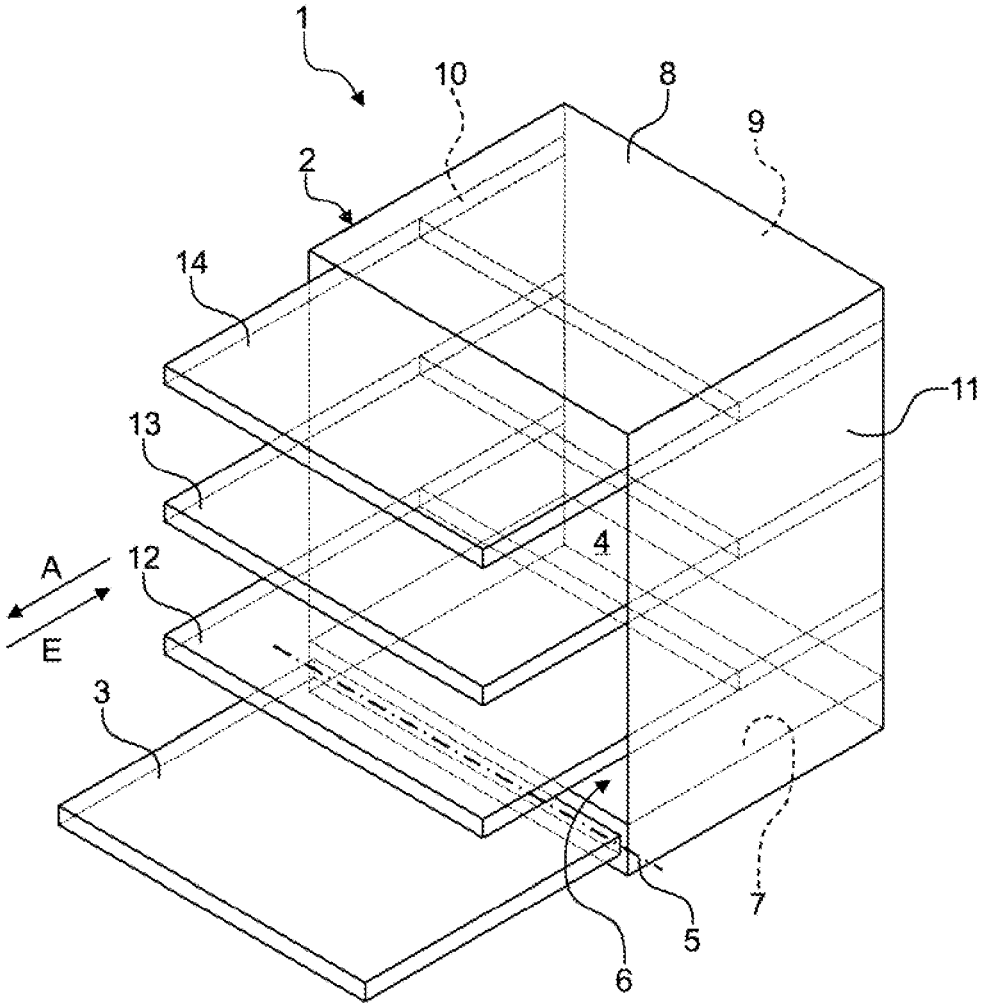
FIG. 1 shows a schematic perspective view of an embodiment of a household dishwasher.

In the figures, identical or functionally identical elements have been given the same reference characters unless otherwise indicated.

FIG. 1 shows a schematic perspective view of an embodiment of a household dishwasher 1. The household dishwasher 1 comprises a dishwasher interior 2, which can be closed via a door 3, in particular in a watertight manner. For this purpose, a sealing facility can be provided between the door 3 and the dishwasher interior 2. The dishwasher interior 2 is preferably cuboidal. The dishwasher interior 2 can be arranged in a housing of the household dishwasher 1. The dishwasher interior 2 and the door 3 can form a dishwasher cavity 4 so as to wash items to be washed.

The door 3 is shown in FIG. 1 in its open position. The door 3 can be closed or opened by pivoting about a pivot axis 5 that is provided at a lower end of the door 3. By means of the door 3, a loading opening 6 of the dishwasher interior 2 can be closed or opened. The dishwasher interior 2 has a floor 7, a ceiling 8 that is arranged opposite the floor 7, a rear wall 9 that is arranged opposite the closed door 3 and two side walls 10, 11 that are arranged opposite one another. The floor 7, the ceiling 8, the rear wall 9 and the side walls 10, 11 can, for example, be made of a stainless steel sheet. Alternatively, the floor 7 can be made of a plastic material, for example.

The household dishwasher 1 further comprises at least one receptacle 12 to 14 for items to be washed. It is preferred that several, for example three, receptacles 12 to 14 for items to be washed can be provided, wherein the receptacle 12 for items to be washed can be a lower receptacle for items to be washed or a lower basket, the receptacle 13 for items to be washed can be an upper receptacle for items to be washed or an upper basket, and the receptacle 14 for items to be washed can be a cutlery drawer. As FIG. 1 further shows, the receptacles 12 to 14 for items to be washed are arranged one above the other in the dishwasher interior 2. Each receptacle 12 to 14 for items to be washed can optionally be moved into or out of the dishwasher interior 2. In particular, each receptacle 12 to 14 for items to be washed can be pushed or moved into the dishwasher interior 2 in an insertion direction E and can be pulled or moved out of the dishwasher interior 2 in an extraction direction A opposite to the insertion direction E.

Figure 2:
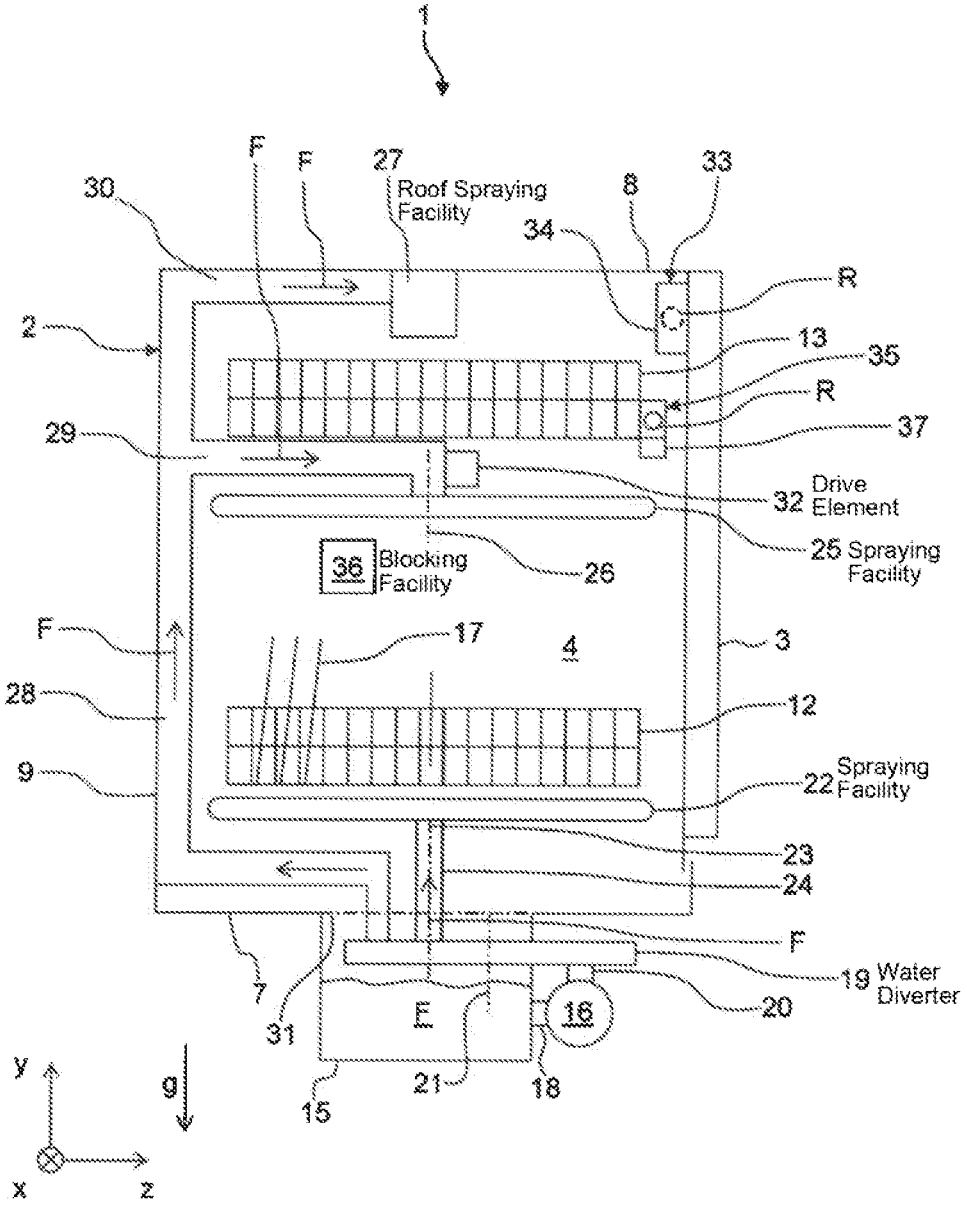
FIG. 2 shows a schematic sectional view of the household dishwasher according to FIG. 1.

FIG. 2 shows a schematic sectional view of the household dishwasher 1. The household dishwasher 1 is assigned a coordinate system with an x-direction or width direction x, a y-direction or height direction y, and a z-direction or depth direction z. The width direction x is oriented from the side wall 10 in the direction of the side wall 11. The height direction y is oriented from the floor 7 in the direction of the ceiling 8. The depth direction z is oriented from the rear wall 9 in the direction of the closed door 3. The directions x, y, z are positioned perpendicular with respect to one another. A direction of gravity g is oriented from the ceiling 8 in the direction of the floor 7 and thus opposite to the height direction y.

FIG. 2 shows only the receptacles 12, 13 for items to be washed that are accommodated in the dishwasher interior 2. The receptacle 14 for items to be washed is not shown in FIG. 2. A pump sump or pump pot 15 is provided on the dishwasher interior 2, in particular on the floor 7 of the dishwasher interior 2. The pump pot 15 can be a plastic component, in particular an injection molded plastic component. The pump pot is suitable for circulating wash liquor and/or fresh water F in the dishwasher interior 2 by means of a circulating pump 16, and thus for spraying items 17 to be washed, which are received in the dishwasher interior 2, with wash liquor and/or fresh water F The circulating pump 16 is in fluid communication with the pump pot 15 by means of a conduit 18, so that the circulating pump 16 can draw off wash liquor and/or fresh water F from the pump pot 15 and feed it to a water diverter 19. The circulating pump 16 is in fluid communication with the water diverter 19 by means of a conduit 20. The water diverter 19 comprises a perforated disc or disc with perforations, or is formed as a perforated disc or disc with perforations, which is rotatably mounted about an axis of rotation 21. A drive element, for example an electric motor, can be provided for driving the water diverter 19.

A lower spraying facility 22 is accommodated in the dishwasher interior 2. The lower spraying facility 22 is rotatably mounted about an axis of rotation 23. The lower spraying facility 22 is in particular a spray arm. The lower spraying facility 22 can be arranged below the receptacle 12 for items to be washed as viewed along the height direction y or along the direction of gravity g, respectively. The lower spraying facility 22 is in fluid communication with the water diverter 19 by means of a conduit 24.

Furthermore, an upper spraying facility 25 is arranged in the dishwasher interior 2 and is rotatably mounted about an axis of rotation 26. The upper spraying facility 25 is arranged above the lower spraying facility 22 as viewed along the height direction y or along the direction of gravity g, respectively. The upper spraying facility 25 can be arranged below the receptacle 13 for items to be washed, as viewed along the height direction y or the direction of gravity g, and thus between the receptacles 12, 13 for items to be washed. The upper spraying facility 25 is also a spray arm. The upper spraying facility 25 can be attached to the receptacle 13 for items to be washed. By means of the spraying facilities 22, 25, the items 17 to be washed can be wetted or sprayed with wash liquor and/or fresh water F.

The household dishwasher 1 further comprises a roof spraying facility 27 that is arranged within the dishwasher interior 2. In particular, the roof spraying facility 27 is arranged on the ceiling 8. The roof spraying facility 27 can be a roof gyro or a spray nozzle. Also by means of the roof spraying facility 27, the items 17 to be washed can be wetted with wash liquor and/or fresh water F. Viewed along the height direction y or along the direction of gravity g, the roof spraying facility 27 is positioned above the upper spraying facility 25 and above the receptacle 13 for items to be washed.

A water-carrying system 28 for supplying wash liquor and/or fresh water F to the upper spraying facility 25 and to the roof spraying facility 27 is guided away from the water diverter 19 and to the rear of the rear wall 9 along the height direction y and along the direction of gravity g, respectively. The water-carrying system 28 can have a feed pipe or be formed as a feed pipe. In other words, the term "water-carrying system" can be replaced by the term "feed pipe". However, the water-carrying system 28 is not limited to the feed tube.

Furthermore, the water-carrying system 28 can comprise any other water-carrying components in addition to the feed tube. For example, the water-carrying system 28 can comprise any water-carrying conduits, spray arms, intensive spray zones, or generally a spray system or the like. The water-carrying system 28 can comprise any combination of the aforementioned components. Hereinafter, it will be understood that the water-carrying system 28 is a feed pipe of the household dishwasher 1.

The water-carrying system 28 branches towards the upper spraying facility 25 and towards the roof spraying facility 27. In particular, a first duct 29 branches from the water-carrying system 28 at the level of the upper spraying facility 25. At the first duct 29, the upper spraying facility 25 is rotatably mounted about the axis of rotation 26. The first duct 29 can be attached to the receptacle 13 for items to be washed. By means of the first duct 29, wash liquor and/or fresh water F can be supplied to the upper spraying facility 25.

Furthermore, a second duct 30 branches off from the water-carrying system 28 at the level of the roof spraying facility 27 and by means of said second duct wash liquor and/or fresh water F can be supplied to the roof spraying facility 27. The ducts 29, 30 are part of the water-carrying system 28. The water-carrying system 28 is a plastic component or comprises a plurality of plastic components.

As FIG. 2 further shows, the pump pot 15 is covered by means of a fine screen 31. The fine screen 31 can be a plastic component or a metal component. In addition, a coarse screen or coarse dirt separator not shown in FIG. 2 is also provided. The fine screen 31 and the coarse screen form a filter system for filtering out dirt particles from the wash liquor and/or the fresh water F.

In the following, only the upper spraying facility 25 will be discussed. However, the following explanations concerning the upper spraying facility 25 can also be applied accordingly to the lower spraying facility 22. As previously mentioned, the upper spraying facility 25 is mounted in the dishwasher interior 2 in such a manner as to be able to rotate about the axis of rotation 26. In particular, the upper spraying facility 25 is rotatably mounted on the first duct 29. The first duct 29 can be connected to the receptacle 13 for items to be washed, so that the upper spraying facility 25 is also connected to the receptacle 13 for items to be washed. For this purpose, the first duct 29 can have a coupling which allows the first duct 29 to be uncoupled from the water-carrying system 28 when the upper receptacle 13 for items to be washed together with the first duct 29 and the upper spraying facility 25 is moved out of the dishwasher interior 2 in the extraction direction A.

The upper spraying facility 25 can be driven by means of wash liquor and/or fresh water F emerging from the upper spraying facility 25. In this case, the wash liquor and/or fresh water F exits the upper spraying facility 25 from extra drive nozzles provided so that the upper spraying facility 25 is caused to rotate about the axis of rotation 26.

Alternatively, the upper spraying facility 25 can be actively driven by means of a drive element 32. "Actively" means in the present case that the drive element 32 sets the upper spraying facility 25 in rotation. In other words, in this case it is not the emerging wash liquor and/or the fresh water F that sets the upper spraying facility 25 in rotation, but the drive element 32. In contrast, a "passive" drive of the upper spraying facility is understood to mean that no separate drive element 32 is provided, but that the upper spraying facility 25 is set in rotation exclusively by means of the wash liquor and/or the fresh water F emerging from the upper spraying facility 25.

A metering device or metering facility 33 can be provided on the inside of the door 3. The metering facility 33 is configured so as to receive a cleaning agent R therein. The cleaning agent R can, for example, be in liquid or powder form. The cleaning agent R can also be in the form of a tab or tablet. In other words, the cleaning agent R can be a cleaning agent tablet. The metering facility 33 comprises a lid 34 that opens during a wash cycle of the household dishwasher 1 so that the cleaning agent R drops into or onto a placement region 35 that is provided on the receptacle 13 for items to be washed.

The placement region 35 can be box-shaped or trough-shaped, for example. In the placement region 35, the cleaning agent R is dissolved by means of wash liquor and/or fresh water F emerging from the upper spraying facility 25. For this purpose, the placement region 35 can be screen-shaped or grid-shaped, for example. However, the cleaning agent R is only sprayed with wash liquor and/or fresh water F when the upper spraying facility 25 moves past the placement region 35. This passage in the upper spraying facility 25 past the placement region 35 can cover an angle of about 35° of rotation of the upper spraying facility 25. Thus, two end portions of the upper spraying facility 25 effectively flush the cleaning agent R to only about 20% of a rotation of the upper spraying facility 25. As a result, it takes several minutes to dissolve the cleaning agent R. During this time of dissolving the cleaning agent R, the full cleaning performance is not yet available. This must be improved.

In order to ensure better dissolution of the cleaning agent R, the household dishwasher 1 comprises a blocking facility 36, which is configured so as to block the rotational movement of the upper spraying facility 25 in such a manner that the upper spraying facility 25 selectively sprays the placement region 35 with wash liquor and/or fresh water F during the blocking thereof, in order to dissolve the cleaning agent R. The blocking facility 36 can operate mechanically, electronically or in any other manner.

The only important aspect is that the blocking facility 36 is suitable for blocking or stopping the upper spraying facility 25 at least temporarily during a wash program of the household dishwasher 1, so that the cleaning agent R can be dissolved quickly at the beginning of the wash program. As a result of the fact that the upper spraying facility 25 selectively sprays or wets only the placement region 35, a significantly improved dissolution behavior of the cleaning agent R can be achieved in comparison to a household dishwasher without such a blocking facility 36.

In the case where the upper spraying facility 25 is actively driven by means of the drive element 32, the blocking facility 36 controls the drive element 32 in such a manner that the upper spraying facility 25 is blocked and, for example, a spray nozzle of the upper spraying facility 25 is directed directly at the placement region 35 in order to dissolve the cleaning agent R as quickly as possible. In this case, the blocking facility 36 can, for example, be part of a control unit of the household dishwasher 1. In particular, in this case, the blocking facility 36 can also be part of a wash program of the household dishwasher 1 that is stored in the control unit.

In this case, the blocking facility 36 unblocks the upper spraying facility 25 as soon as a residual weight of the cleaning agent R falls below a predetermined limit value. The limit value can be, for example, 1 g or even less. In other words, the blocking facility 36 releases the blocking of the upper spraying facility 25 only when the cleaning agent R is preferably completely dissolved or at least almost dissolved.

The placement region 35 can comprise a geometry 37 that is configured so as to fan out a spray jet of the upper spraying facility 25. This wets the entire cleaning agent R, causing it to dissolve more quickly. The geometry 37 can, for example, be frustoconical or wedge-shaped. The geometry 37 is provided on the underside of the placement region 35.

Figure 3:
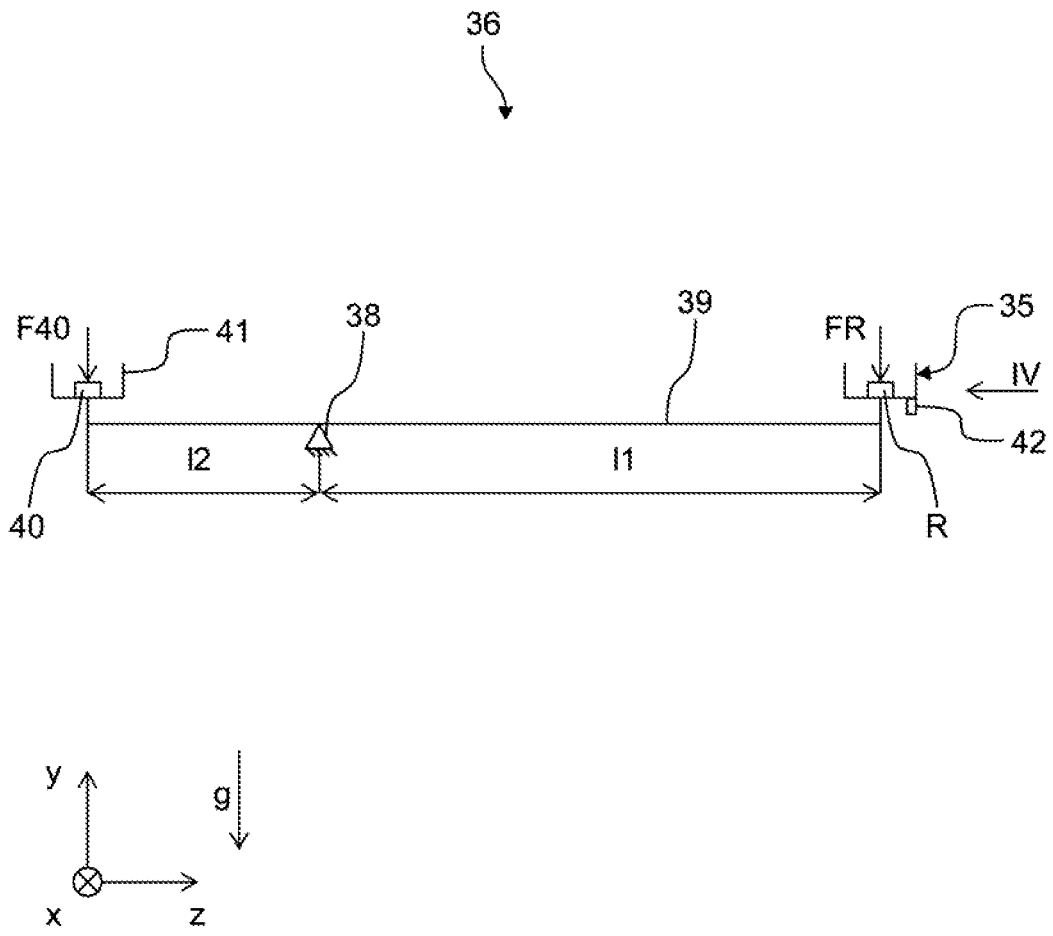
FIG. 3 shows a schematic view of an embodiment of a blocking facility for the household dishwasher according to FIG. 1.
Figure 4:
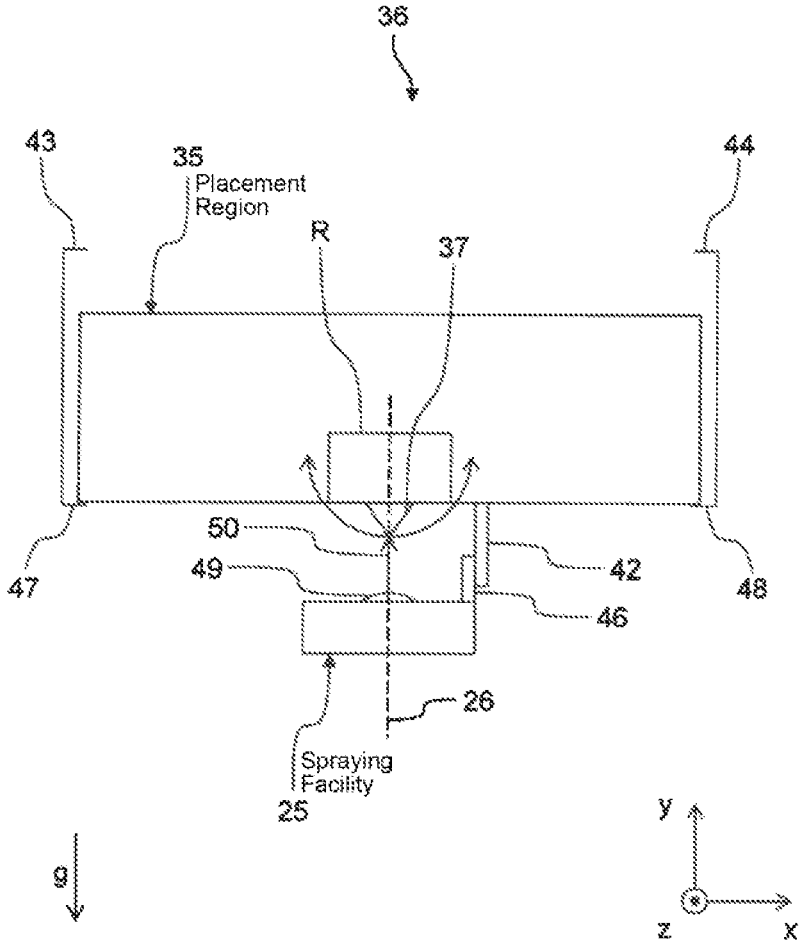
FIG. 4 shows the view IV according to FIG. 3.
Figure 5:
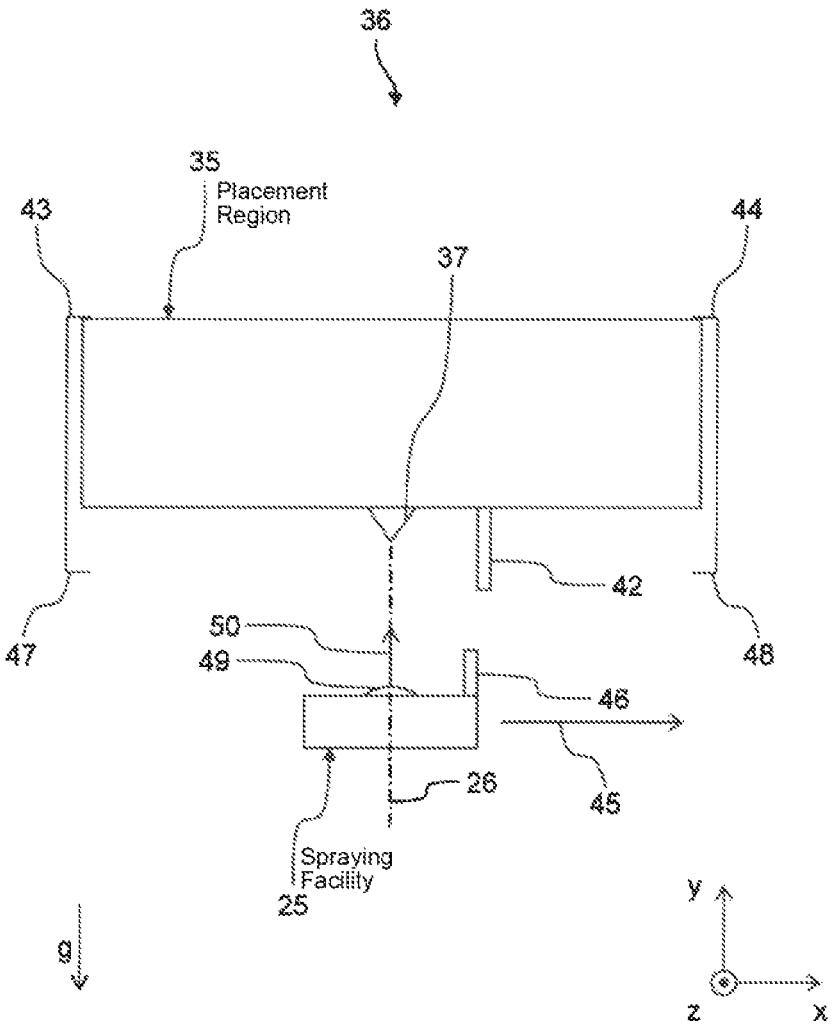
FIG. 5 again shows the view IV according to FIG. 3.

FIG. 3 shows a schematic view of an embodiment of a blocking facility 36 that is suitable for mechanically blocking the upper spraying facility 25. FIGS. 4 and 5 each show the view IV according to FIG. 3. In the following, reference is made to FIGS. 3 to 5 simultaneously.

The blocking facility 36 comprises a rocker 39 that is rotatably mounted at a bearing location 38. The bearing location 38 is provided, for example, at the receptacle 13 for items to be washed. The placement region 35 which in this case is box-shaped is provided on the end side of the rocker 39. The placement region 35 is suitable for receiving the cleaning agent R. The cleaning agent R exhibits a weight force FR. At its other end portion, the rocker 39 has a counterweight 40 with a weight force F40. The counterweight 40 can, for example, be accommodated in a cup-shaped receiving region 41. However, the counterweight 40 can also be directly connected to the rocker 39.

The bearing location 38 is placed off-center on the rocker 39. The cleaning agent R is placed at a distance from the bearing location 38 by a lever arm 11. The counterweight 40, on the other hand, is placed at a distance from the bearing location 38 by a lever arm 12. Here, the lever arm I1 is larger than the lever arm 12. A stop 42 is provided at the placement region 35 and said stop extends downward in the direction of the upper spraying facility 25.

The counterweight 40 can, for example, be made of metal, plastic, concrete or the like. The counterweight 40 can also be, for example, wash liquor and/or fresh water F. The counterweight 40 can either be pre-assembled or variably modified by a customer with respect to its mass. Furthermore, it can be possible to change the position of the counterweight 40 on the rocker 39 or the position of the bearing location 38.

As long as the placement region 35 is empty, the counterweight 40 lifts the placement region 35 upwards against an upper stop 43, 44 (FIG. 5), so that the upper spraying facility 25 can rotate unhindered under the placement region 35, as shown in FIG. 5 by means of an arrow 45. As long as the cleaning agent R is not yet in the placement region 35, the stop 42 is out of engagement with a counter stop 46 that is provided on the upper spraying facility 25. In other words, the stop 42 and the counter stop 46 do not contact one another so that the rotational movement of the upper spraying facility 25 is not impeded.

As soon as the cleaning agent R drops into the placement region 35 after the metering facility 33 has been opened, the balance of the rocker 39 is shifted. The placement region 35 tilts downward to a lower stop 47, 48 (FIG. 4). In this position, the upper spraying facility 25 can no longer rotate freely because the counter stop 46 impacts against the stop 42. In other words, the upper spraying facility 25 can only rotate until the counter stop 46 impacts against the stop 42.

A spray nozzle 49 of the upper spraying facility 25 is now located immediately below the cleaning agent R, wherein the geometry 37 that is provided at the placement region 35 fans out a spray jet 50 emerging from the spray nozzle 49 so that the entire cleaning agent R is sprayed with wash liquor and/or fresh water F and dissolves more quickly.

In particular, the geometry 37 fans out the spray jet 50 from the spray nozzle 49 so that the cleaning agent R is wetted no matter where it is located on or in the placement region 35. As soon as most or all of the cleaning agent R is dissolved, the placement region 35 raises again with the aid of the counterweight 40 so that the counter stop 46 moves out of engagement with the stop 42. The upper spraying facility 25 can now rotate freely again and sprays the items 17 to be washed.

Figure 6:
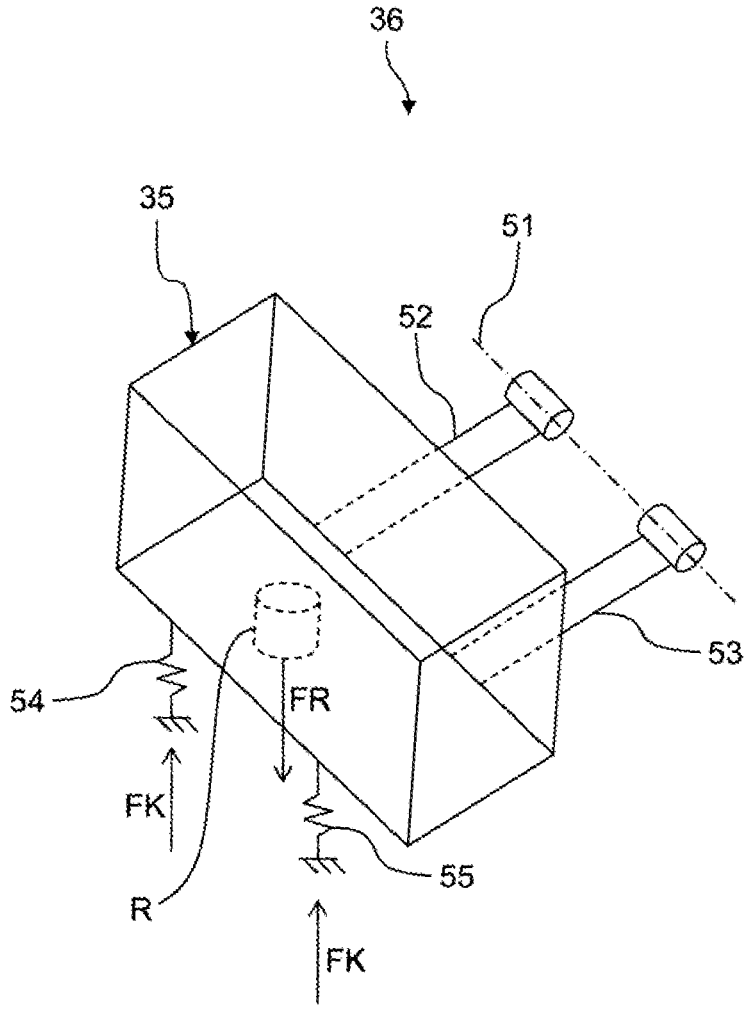
FIG. 6 shows a schematic perspective view of a further embodiment of a blocking facility for the household dishwasher according to FIG. 1.

FIG. 6 shows a schematic view of a further embodiment of a blocking facility 36. In this embodiment of the blocking facility 36, the placement region 35 is cup-shaped or trough-shaped and is suitable for receiving the cleaning agent R. For example, the placement region 35 is mounted on the cleaning agent receptacle 13 in such a manner as to be able to rotate about an axis of rotation 51. For this purpose, the placement region 35 can comprise two arm sections 52, 53 which are rotatably mounted about the axis of rotation 51.

The blocking facility 36 further comprises spring elements 54, 55 which apply a spring force FK to the placement region 35 which acts against the weight force FR of the cleaning agent R. The spring elements 54, 55 can, for example, be mounted on the receptacle 13 for items to be washed.

If the cleaning agent R is now placed in the placement region 35, the cleaning agent R compresses the spring elements 54, 55 since the weight force FR is greater than the spring force FK. As soon as the weight force FR is smaller than the spring force FK, the spring elements 54, 55 push the placement region 35 upwards so that the upper spraying facility 25 can rotate freely.

Figure 7:
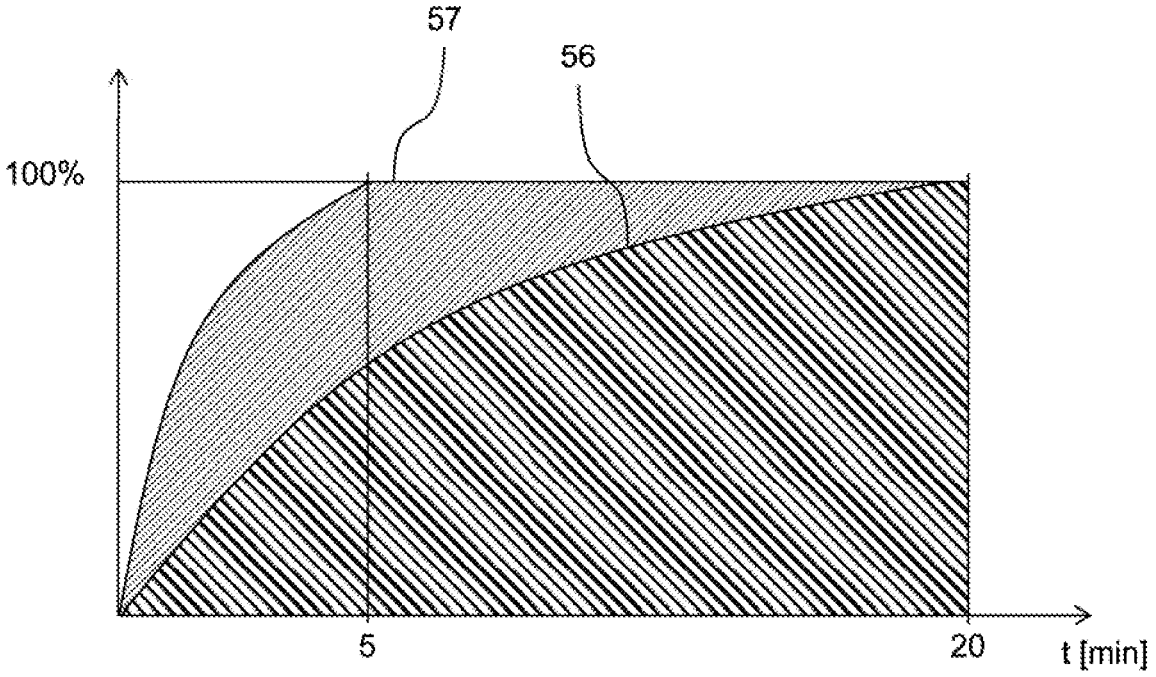
FIG. 7 shows a schematic diagram in which the dissolution of a cleaning agent is plotted against time.

FIG. 7 shows the dissolution behavior of the cleaning agent R of a household dishwasher 1 with a blocking facility 36 as explained previously in comparison with a household dishwasher without such a blocking facility 36. In this case, a curve 56 shows the dissolution behavior in the case of a household dishwasher without such a blocking facility 36, and a curve 57 shows the dissolution behavior in the case of the household dishwasher 1 explained previously. In this case, the dissolution of the cleaning agent R in percent is plotted on the ordinate. However, the time t is plotted on the abscissa.

As shown in comparison of curves 56, 57, complete dissolution of the cleaning agent R can be expected after only 5 minutes in the case of the household dishwasher 1 with the blocking facility 36. In the case of the household dishwasher without such a blocking facility 36, complete dissolution of the cleaning agent R can only be expected after 20 minutes. Due to the significantly steeper rise of curve 57 in comparison with curve 56, the same cleaning performance is achieved at an earlier time. As a result, a wash program can be shortened with the same cleaning result. This leads to energy savings and increases convenience.

The respective hatched regions under curves 56, 57 represent the cleaning performance. Thus, the cleaning performance of the household dishwasher 1 with the blocking facility 36 is greater in comparison to a household dishwasher, not shown, without such a blocking facility 36.

Although the present invention has been described with reference to exemplary embodiments, it can be modified in a variety of ways.

The invention claimed is:

1. A household dishwasher, comprising:

a dishwasher interior;

a spraying facility rotatably mounted in the dishwasher interior for spraying wash liquor and/or fresh water upon an item to be washed received in the dishwasher interior;

a metering facility located on a wall or a door within the dishwasher interior to receive a cleaning agent;

a placement region for placement of the cleaning agent, the placement region having an open top and aligned with the metering facility to receive the cleaning agent from the metering facility during a wash cycle of the household dishwasher; and a blocking facility configured to block a rotational movement of the spraying facility in such a manner that the spraying facility during blocking of the spraying facility selectively sprays the placement region with wash liquor and/or fresh water in order to dissolve the cleaning agent.

2. The household dishwasher of claim 1, further comprising a receptacle accommodated in the dishwasher interior for the item to be washed, said placement region being provided on the receptacle.

3. The household dishwasher of claim 2, wherein the spraying facility is rotatably mounted on the receptacle.

4. The household dishwasher of claim 1, wherein the spraying facility is arranged below the placement region as viewed along a direction of gravity.

5. The household dishwasher of claim 1, wherein the blocking facility is configured to unblock the spraying facility as soon as a residual weight of the cleaning agent falls below a predetermined limit value.

6. The household dishwasher of claim 1, wherein the placement region comprises a geometry configured to fan out a spray jet of the spraying facility.

7. The household dishwasher of claim 1, further comprising a drive element configured to actively drive the spraying facility, said blocking facility controlling the drive element such as to block the rotational movement of the spraying facility.

8. The household dishwasher of claim 1, wherein the spraying facility is drivable by the wash liquor and/or fresh water emerging from the spraying facility, said blocking facility configured to mechanically block the spraying facility for blocking the rotational movement of the spraying facility.

9. The household dishwasher of claim 8, wherein the blocking facility comprises a rotatably mounted rocker which has the placement region at a first end portion and a counterweight to the cleaning agent at a second end portion that is remote from the first end portion, said placement region blocking the rotational movement of the spraying facility when in contact with the spraying facility.

10. The household dishwasher of claim 9, wherein the placement region comprises a stop which is in contact with a corresponding counter stop of the spraying facility so as to block the rotational movement of the spraying facility.

11. The household dishwasher of claim 9, wherein the rocker is mounted off-center.

12. The household dishwasher of claim 9, wherein a first lever arm of the cleaning agent is larger than a second lever arm of the counterweight.

13. The household dishwasher of claim 9, wherein the counterweight is modifiable and/or a bearing location of the rocker is displaceable in order to adapt the blocking facility to a different type of the cleaning agent.

14. The household dishwasher of claim 8, wherein the placement region is mounted in the dishwasher interior for rotation about an axis of rotation, said cleaning agent displacing the placement region against a spring force of a spring element in such a manner that the placement region mechanically blocks the spraying facility so as to block the rotational movement of the spraying facility.

15. The household dishwasher of claim 14, wherein the placement region releases the spraying facility as soon as a weight force of the cleaning agent is smaller than the spring force.

16. The household dishwasher of claim 1, wherein the placement region is box- shaped or trough-shaped.

17. The household dishwasher of claim 1, wherein the placement region is a tray.

18. A household dishwasher, comprising:

a dishwasher interior;

a spraying facility rotatably mounted in the dishwasher interior for spraying wash liquor and/or fresh water upon an item to be washed received in the dishwasher interior, the spraying facility rotationally drivable by wash liquor and/or fresh water emerging from the spraying facility;

a placement region for placement of a cleaning agent; and a blocking facility comprising a rotatably mounted rocker which has the placement region at a first end portion and a counterweight to the cleaning agent at a second end portion that is remote from the first end portion, the blocking facility configured so that the placement region mechanically blocks a rotational movement of the spraying facility in such a manner that the spraying facility, during blocking of the spraying facility, selectively sprays the placement region with wash liquor and/or fresh water in order to dissolve the cleaning agent.

19. The household dishwasher of claim 18, further comprising a receptacle accommodated in the dishwasher interior for the item to be washed, the placement region being provided on the receptacle.

20. The household dishwasher of claim 18, wherein the spraying facility is arranged below the placement region as viewed along a direction of gravity.

* * * * *